US005803872A

United States Patent [19]

Chang

[11] Patent Number: 5,803,872

[45] Date of Patent: Sep. 8, 1998

[54] STEP EXERCISER

[76] Inventor: Shao Ying Chang, 1F, No. 764, Chung Hsang S. Rd., Yang-Mai Town, Tao-Yuan Town, Taiwan

[21] Appl. No.: 944,587

[22] Filed: Oct. 6, 1997

[51] Int. Cl.[6] ..... A63B 22/04

[52] U.S. Cl. ..... 482/52; 482/51

[58] Field of Search ..... 482/51, 52, 53, 482/57, 62, 70, 71, 79, 80

[56] References Cited

U.S. PATENT DOCUMENTS

| | | | |
|---|---|---|---|
| 5,040,786 | 8/1991 | Jou | 482/52 |
| 5,163,886 | 11/1992 | Seol | 482/57 |
| 5,298,002 | 3/1994 | Lin | 482/53 |
| 5,423,729 | 6/1995 | Eschenbach | 482/57 |
| 5,676,623 | 10/1997 | Yu | 482/53 |

*Primary Examiner*—Stephen R. Crow

*Attorney, Agent, or Firm*—Rosenberg, Klein & Bilker

[57] ABSTRACT

A step exerciser including a main shaft supported on a rear transverse bar and a horizontally disposed front barrel, an axle mounted in the horizontally disposed front barrel, two oscillating bars turned about the axle at two opposite sides of the main shaft, two actuating bars having a respective front end respectively pivoted to the oscillating bars and a respective rear end, two front links and two rear links respectively pivoted together and pivotably coupled between the oscillating bars and the rear ends of the actuating bars, a driving wheel revolvably supported in a rear wheel slot in the main shaft, two cranks coupled between the driving wheel and the rear links, a fly wheel revolvably supported in a front wheel slot in the main shaft and coupled to the driving wheel by a transmission belt, two foot plates respectively supported on the actuating bars, and two handlebars respectively pivoted to the top onds of the oscillating bars.

5 Claims, 4 Drawing Sheets

STEP EXERCISER

BACKGROUND OF THE INVENTION

The present invention relates to an exercising machine, and more specifically to a step exerciser in which the foot plates are forced to move along an oval track.

A regular step exerciser generally comprises a main frame having a fixed transverse front bar, two pedals having a respective front end respectively and bilaterally pivoted to the transverse front bar and a respective rear end supported on a respective hydraulic cylinder, and a steering gear coupled between the pedals. This structure of step exerciser is functional, however it still has drawbacks. Because the pedals are directly pivoted to the fixed transverse front bars, they can only be monotonously oscillated up and down. During exercise, every step causes no effect to a next step. Therefore, this structure of step exerciser can only exercise stepping on the same location without simulating the exercise of jogging.

SUMMARY OF THE INVENTION

It is one object of the present invention to provide a step exerciser which enables the user to simulate the exercise of jogging. It is another object of the present invention to provide a step exerciser which produces a satisfactory exercising result that attracts people to use it. To achieve these and other objects of the present invention, there is provided a step exerciser comprised of a main shaft supported on a rear transverse bar and a horizontally disposed front barrel, an axle mounted in the horizontally disposed front barrel, two oscillating bars turned about the axle at two opposite sides of the main shaft, two actuating bars having a respective front end respectively pivoted to the oscillating bars and a respective rear end, two front links and two rear links respectively pivoted together and pivotably coupled between the oscillating bars and the rear ends of the actuating bars, a driving wheel revolvably supported in a rear wheel slot in the main shaft, two cranks coupled between the driving wheel and the rear links, a fly wheel revolvably supported in a front wheel slot in the main shaft and coupled to the driving wheel by a transmission belt, two foot plates respectively supported on the actuating bars, and two handlebars respectively pivoted to the top onds of the oscillating bars.

DETAILED DESCRIPTION OF THE PREFERRED EMBODIMENT

Figure 1:
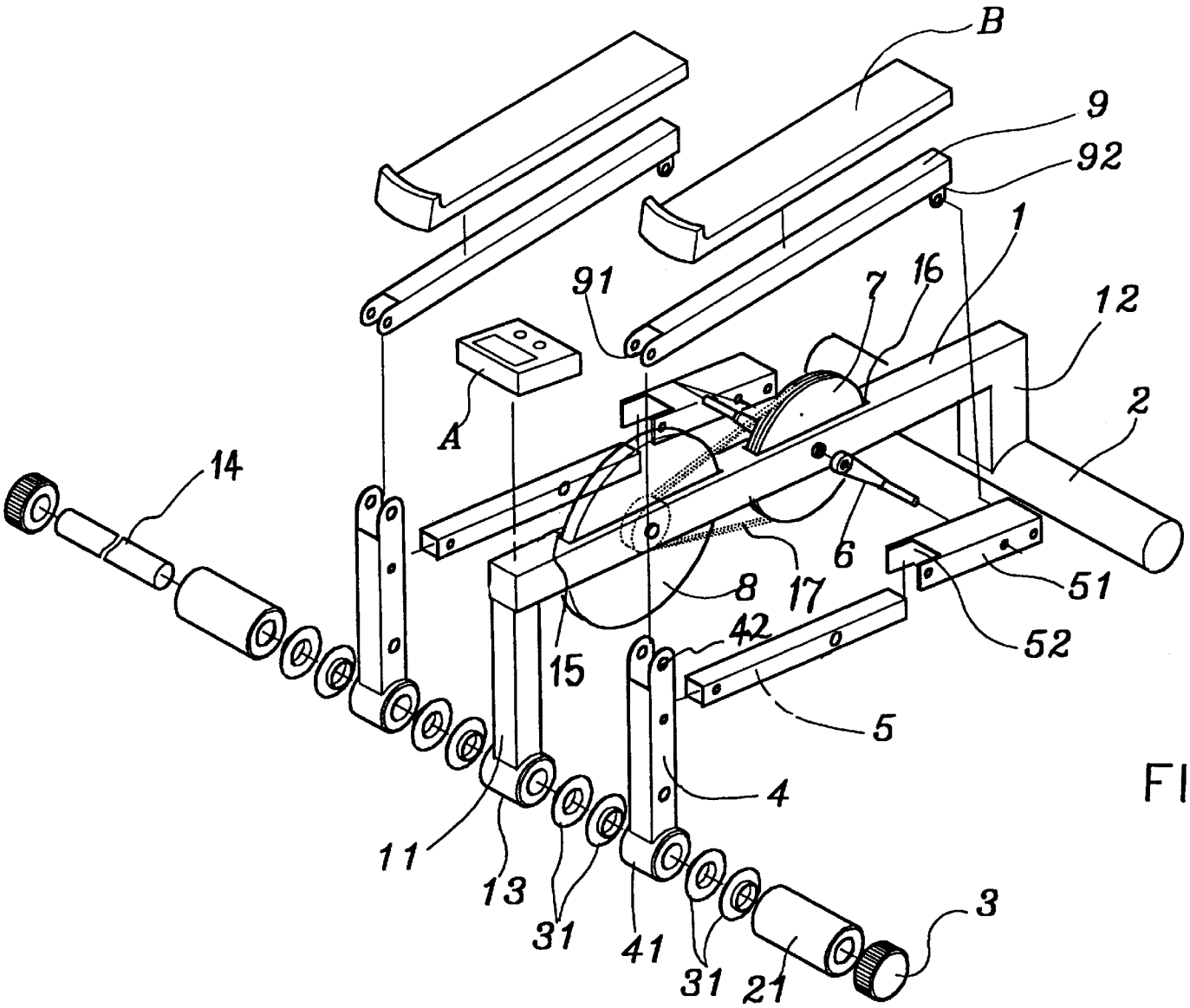
FIG. 1 is an exploded view of a step exerciser according to the present invention (handlebars excluded)

Referring to FIG. 1, a step exerciser in accordance with the present invention comprises a main shaft 1 having a downwardly vertically extended front rod 11 and a downwardly vertically extended rear rod 12 at its two opposite ends, a transverse rear bar 2 fixedly connected to the downwardly vertically extended rear rod 12 of the main shaft 1 for supporting it on the ground, a horizontally disposed barrel 13 fixedly connected to the downwardly vertically extended front rod 11 of the main shaft 1 for supporting it on the ground, two horizontal tubes 21 connected to the horizontally disposed barrel 13 at two opposite sides by an axle 14 and two end caps 3, and two oscillating bars 4 turned about the axle 14 and connected between the barrel 13 of the main shaft 1 and the horizontal tubes 21. Each oscillating bar 4 has a bottom end terminating in a horizontal barrel 41 sleeved on the axle 14 and connected between the barrel 13 of the main shaft 1 and one horizontal tube 21 by ring caps 31, and a top end terminating in a pair of upwardly extended parallel lugs 42. Two front links 5 are provided having a respective front end respectively pivoted to the oscillating bars 4 below the upwardly extended parallel lugs 42. Two rear links 51 are provided having a respective notched front end 52 respectively pivoted to the rear ends of the front links 5 remote from the oscillating bars 4. Two actuating bars 9 are provided having a respective pair of downwardly extended parallel lugs 92 at the rear end respectively pivoted to the rear ends of the rear links 51 remote from the front links 5, and a respective pair of forwardly extended parallel lugs 91 respectively pivoted to the upwardly extended parallel lugs 42 of the oscillating bars 4. The main shaft 1 further comprises a front wheel slot 15 and a rear wheel slot 16. A driving wheel 16 is revolvably supported in the rear wheel slot 16. A fly wheel 8 is revolvably supported in the front wheel slot 15 and coupled to the driving wheel 16 by a transmission belt 17. Two cranks 6 are bilaterally coupled between the driving wheel 16 and the rear links 51.

Figure 2:
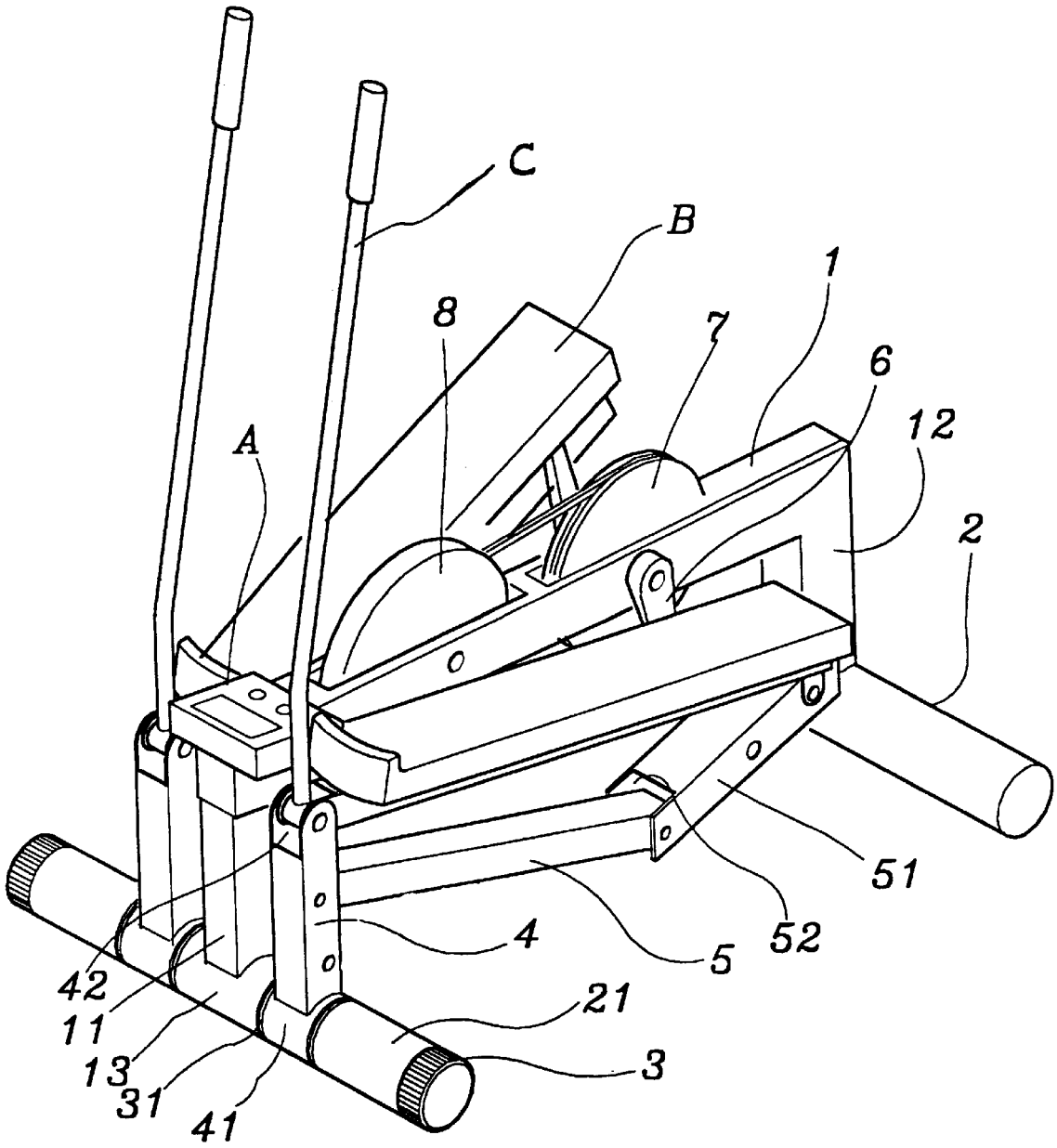
FIG. 2 is an elevational view of the step exerciser according to the present invention.

Referring to FIG. 2 and FIG. 1 again, two foot plates B are respectively and fixedly mounted on the actuating bars 9; two handlebars C are provided having a respective bottom end respectively pivoted to the upwardly extended parallel lugs 42 of the oscillating bars 4 and the forwardly extended parallel lugs 91 of the actuating bars 9; a step counter A is mounted on the main shaft 1 at the front side between the handlebars 9. The bottom end of each handlebar C is preferably made having a friction ring disposed in contact with the front end of the corresponding actuating bar 9 so that the handlebars C can be turned to impart a resisting force to the actuating bars 9 when the user pedals the foot plates B.

Figure 3:
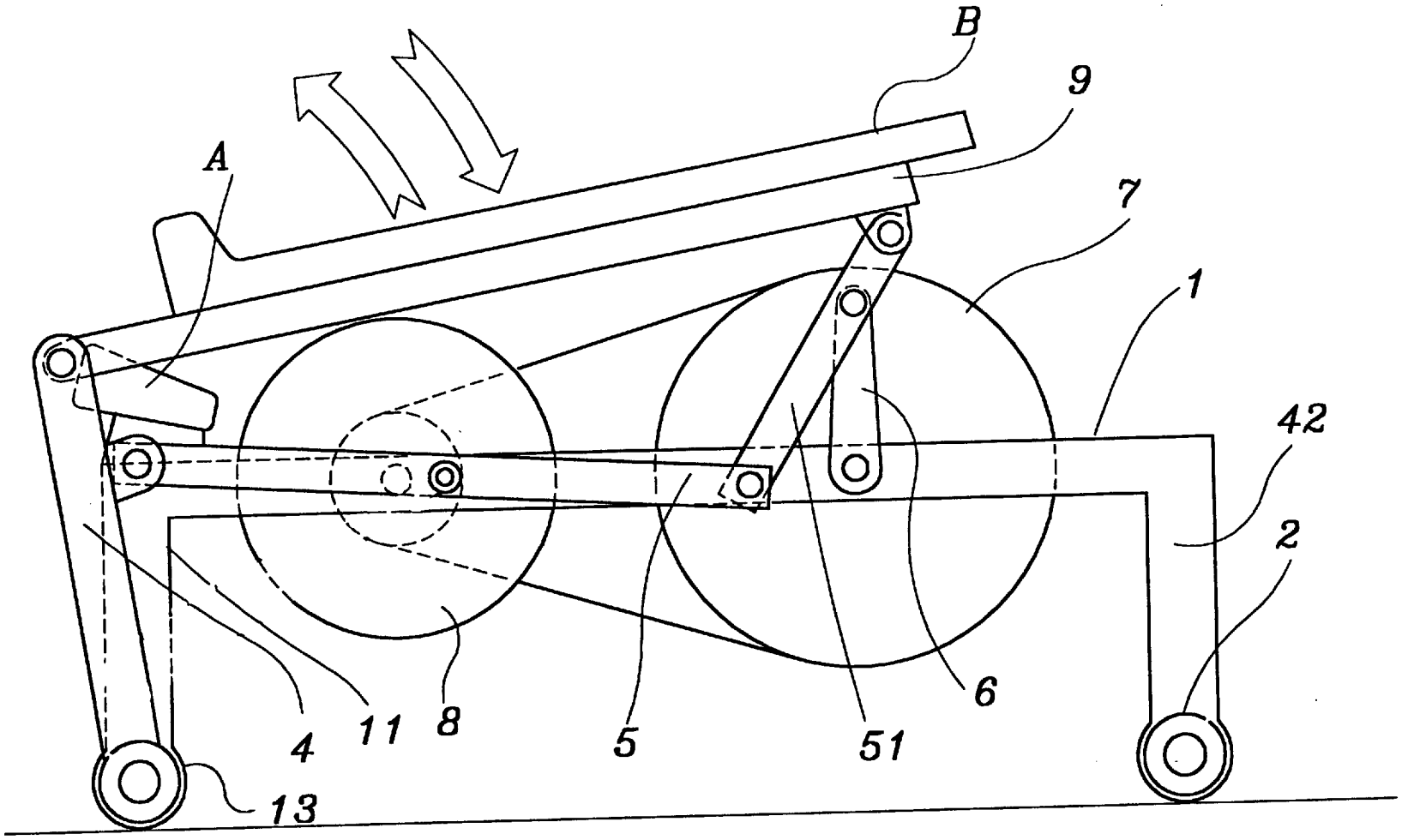
FIG. 3 is a side plain view of the present invention, showing the moving direction of the foot plates.
Figure 4:
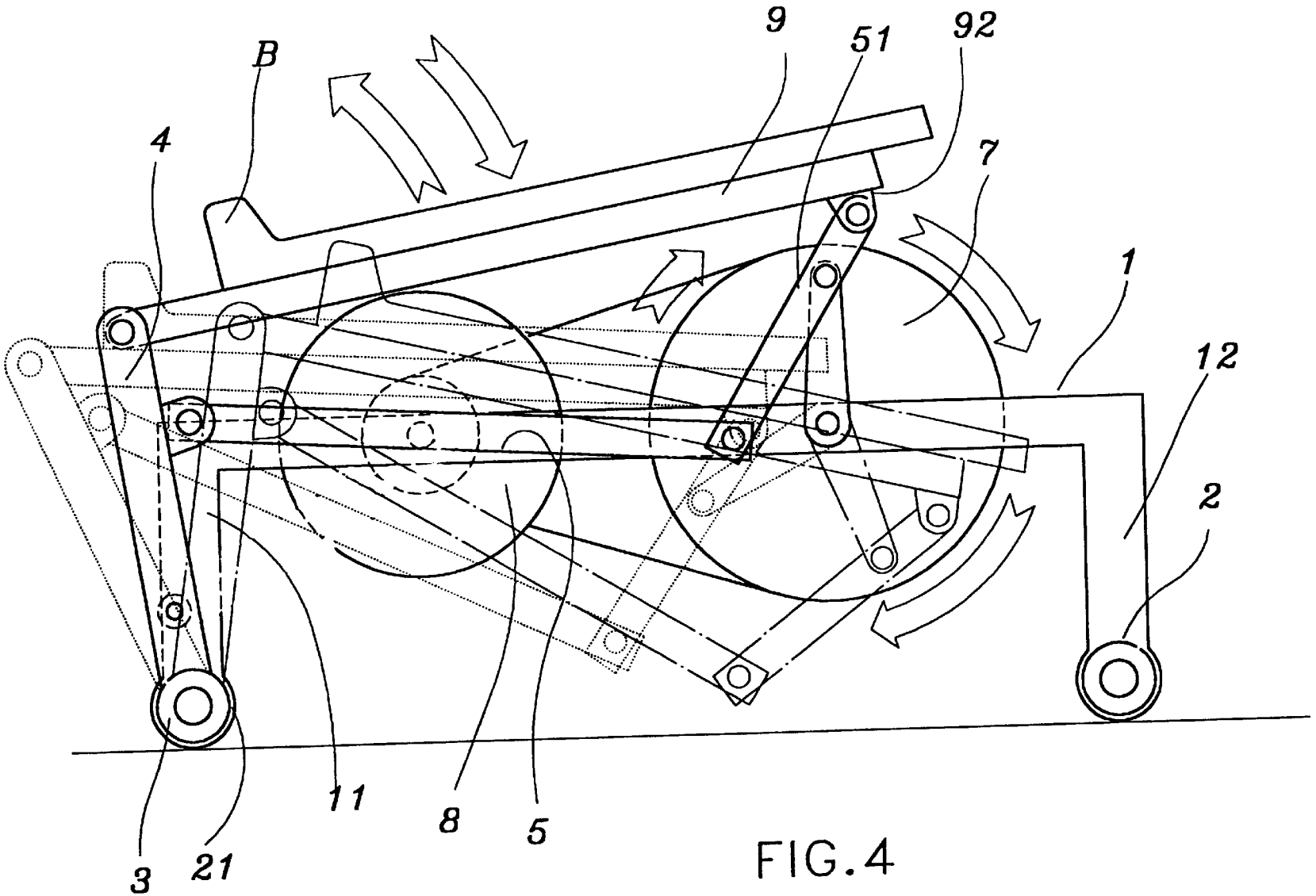
FIG. 4 is another side plain view of the present invention, showing the step exerciser operated.

Referring to FIGS. 3 and 4, when the user steps on the foot plates B alternatively, the rear links 51 are alternatively forced by the actuating bars 9 to turn the driving wheel 7, causing the flywheel 8 to be turned by the transmission belt 17. Because the rear links 51 are respectively pivoted to the front links 5 and the front links 5 are respectively pivoted to the oscillating bars 4, the actuating bars 9 are forced to move along an oval track when the foot plates B are pedaled.

While only one embodiment of the present invention has been shown and described, it will be understood that various modifications and changes could be made thereunto without departing from the spirit and scope of the invention disclosed.

What the invention claimed is:

1. A step exerciser comprising:

a main shaft having a downwardly vertically extended front rod and a downwardly vertically extended rear rod at two opposite ends thereof, a front wheel slot and a rear wheel slot spaced between said downwardly vertically extended front rod and said downwardly vertically extended rear rod, said downwardly vertically extended front rod having a bottom end terminating in a horizontal barrel for supporting on the ground;

a transverse rear bar fixedly connected to the downwardly vertically extended rear rod of said main shaft and adapted to support it on the ground;

two horizontal tubes connected to the horizontally disposed barrel of said downwardly vertically extended front rod of said main shaft at two opposite sides by an axle and two end caps;

two oscillating bars turned about said axle and connected between the horizontally disposed barrel of said downwardly vertically extended front rod of said main shaft and said horizontal tubes, each of said oscillating bars having a bottom end terminating in a horizontal barrel sleeved on said axle and connected between the horizontally disposed barrel of said downwardly vertically extended front rod of said main shaft and one horizontal tube by ring caps, and a top end terminating in a pair of upwardly extended parallel lugs;

two front links having a respective front end respectively pivoted to said oscillating bars at an elevation below the upwardly extended parallel lugs of said oscillating bars, and a respective rear end respectively pivoted to a respective rear link;

two rear links having a respective notched front end respectively pivoted to the rear ends of said front links, and a respective rear end respectively pivoted to a respective actuating bar;

two actuating bars having a respective rear end fixedly mounted with a pair of downwardly extended parallel lugs respectively pivoted to the rear ends of said rear links, and a respective front end terminating in a pair of forwardly extended parallel lugs respectively pivoted to the upwardly extended parallel lugs of said oscillating bars;

a driving wheel revolvably supported in said rear wheel slot of said main shaft;

a fly wheel revolvably supported in said front wheel slot of said main shaft and coupled to said driving wheel by a transmission belt; and two cranks bilaterally coupled between said driving wheel and said rear links.

2. The step exerciser of claim 1 further comprising two handlebars having a respective bottom end respectively pivoted to the upwardly extended parallel lugs of said oscillating bars.

3. The step exerciser of claim 1 further comprising two foot plates respectively and fixedly mounted on said actuating bars.

4. The step exerciser of claim 1 further comprising a step counter mounted on said main shaft above its downwardly vertically extended front rod.

5. The step exerciser of claim 1, wherein each of said actuating bars has its front end terminating in a pair of forwardly extended parallel lugs pivoted to the upwardly extended parallel lugs of one oscillating bar.

* * * * *